United States Patent [19]

Nussbaum

[11] 4,197,716

[45] Apr. 15, 1980

[54] REFRIGERATION SYSTEM WITH AUXILIARY HEAT EXCHANGER FOR SUPPLYING HEAT DURING DEFROST CYCLE AND FOR SUBCOOLING THE REFRIGERANT DURING A REFRIGERATION CYCLE

[75] Inventor: Otto J. Nussbaum, Huntsville, Ala.

[73] Assignee: Halstead Industries, Inc., Scottsboro, Ala.

[21] Appl. No.: 943,013

[22] Filed: Sep. 18, 1978

Related U.S. Application Data

[63] Continuation-in-part of Ser. No. 833,198, Sep. 14, 1977, abandoned.

[51] Int. Cl.[2] ..... F25B 41/00; F25B 47/00

[52] U.S. Cl. ..... 62/196 B; 62/278

[58] Field of Search ..... 62/278, 277, 510, 196 B

[56] References Cited

U.S. PATENT DOCUMENTS

| | | | |
|---|---|---|---|
| 2,888,808 | 6/1959 | Jacobs | 62/278 |
| 3,368,364 | 2/1968 | Norton et al. | 62/278 |
| 3,559,421 | 2/1971 | Nussbaum | 62/196 B |
| 3,638,444 | 2/1972 | Lindahl | 62/278 |
| 3,665,725 | 5/1972 | Barlass et al. | 62/196 B |
| 3,677,025 | 7/1972 | Payne | 62/278 |
| 3,869,874 | 3/1975 | Ditzler | 62/510 |
| 4,083,195 | 4/1978 | Kramer et al. | 62/196 B |

*Primary Examiner*—Lloyd L. King

*Attorney, Agent, or Firm*—Thomas H. Murray

[57] ABSTRACT

A compression-type refrigeration system which utilizes the conventional suction line of such a system as a defrost conduit at periodic intervals and which incorporates an auxiliary heat exchanger which (1) can act to subcool the condensed refrigerant during a refrigeration cycle and (2) acts to heat the refrigerant coming from the receiver of the system during a defrost cycle.

10 Claims, 4 Drawing Figures

44
42
38
40
34A
V
CK
62
44A
34
REG
V
14
46
16
52
18
V
CK
64
V
CK
54
30
32
12
20
58
V
60
36
V
CK
28
10
56
V
26
V
50
REG
V
48
24
22

44
42
38
40
34A
V
CK
62
44A
34
REG
V
14
46
16
52
18
V
CK
64
V
CK
54
30
12
32
20
58
V
60
36
V
CK
28
10
56
V
26
V
50
REG
V
48
24
22

REFRIGERATION SYSTEM WITH AUXILIARY HEAT EXCHANGER FOR SUPPLYING HEAT DURING DEFROST CYCLE AND FOR SUBCOOLING THE REFRIGERANT DURING A REFRIGERATION CYCLE

CROSS-REFERENCES TO RELATED APPLICATIONS

This application is a continuation-in-part of copending application Ser. No. 833,198, filed Sept. 14, 1977, and now abandoned.

BACKGROUND OF THE INVENTION

As is known, a mechanical refrigeration system of the compression type generally consists of a motor-driven compressor, an air or liquid cooled condenser for liquefying the compressed refrigerant, a pressure reducing device and an evaporating unit in which the refrigerant is caused to evaporate at a lower pressure, thereby producing a cooling effect. It is well known that the surface of the evaporator can accumulate frost thereon, particularly in low temperature systems designed to maintain a temperature below 32° F. such as, for example, a frozen food storage room. This is due to the fact that when the surface temperature of the evaporator drops below 32° F., any moisture condensed out of the air flowing over the evaporator will freeze on the evaporator fins. The build-up of frost or ice on the evaporator surfaces acts as an insulator, decreasing the rate of heat transfer through the evaporator and substantially minimizing the efficiency of the refrigeration cycle.

An important aspect of low temperature refrigeration, therefore, is reliable defrost of the evaporator which should be automatic and rapid so as to have the least possible effect on the temperature of the refrigerated space. At the same time, the energy required to heat the evaporator surface for defrosting should preferably be generated within the refrigeration system rather than originate from external sources.

In Nussbaum U.S. Pat. No. 3,559,421, a refrigeration hot gas defrost system is described which utilizes the usual components of a mechanical refrigeration system of the compression type with the addition of means to utilize the conventional suction line as a defrost conduit at periodic intervals. In the aforesaid patent, electrical heating means is provided to heat the liquid refrigerant in the receiver of the system to maintain the refrigerant at sufficient pressure and temperature to serve as a source of heat during a defrost cycle.

While electrical heating of the refrigerant in the receiver to maintain it at sufficient pressure and temperature is satisfactory, it has been found that in large commercial and industrial refrigeration installations with capacities in excess of five tons of refrigeration, a considerable amount of electrical heat input is required to accomplish the evaporation of the liquid refrigerant for the defrost cycle.

It is also known that by subcooling the condensed refrigerant in a compression-type refrigeration system, considerable improvement in the operating economy of the system can be achieved without additional power consumption. Such subcooling of the condensed refrigerant occurs in a separate heat exchanger equipped, for example, with a separate cooling fan or the subcooling heat exchanger can be in tandem with the condenser coil so that the condenser fan forces cooling air through both. From the auxiliary heat exchanger, the liquid refrigerant then passes to the expansion unit of the evaporator. Adding an integral liquid subcooling heat exchanger to an air-cooled condenser increases the compressor-condenser capacity about 0.5% for each degree of liquid subcooling. Assuming that the subcooling heat exchanger is designed to achieve from 10 to 20 degrees subcooling, a 5% to 10% increase in system capacity can be achieved for a given compressor-condenser combination and given condensing temperature.

SUMMARY OF THE INVENTION

In accordance with the present invention, a compression-type refrigeration system is provided which utilizes a single heat exchanger for (1) subcooling during a refrigeration cycle when the ambient outdoor temperature is above 70° F., and (2) heating of the refrigerant during a defrost cycle to maintain it at sufficient pressure and temperature to serve as a source of heat during the defrost cycle. Specifically, there is provided a compressor having discharge and suction sides, a condenser, a liquid refrigerant receiver, an auxiliary heat exchanger, an expansion device and an evaporator interconnected in a closed circuit.

During a normal refrigeration cycle, and assuming that the ambient temperature around the auxiliary heat exchanger is above 70° F., the flow of refrigerant is from the discharge side of the compressor, through the condenser, then to the receiver and through the auxiliary heat exchanger, then through the expansion means and through the evaporator back to the compressor. However, when the ambient temperature around the auxiliary heat exchanger is below about 70° F., the auxiliary heat exchanger is bypassed during a normal refrigeration cycle since additional subcooling at lower temperatures would unnecessarily lengthen the circuit for the refrigerant and the pump-down operation.

The system is such that a defrost cycle will be initiated after a refrigeration cycle of a predetermined time, typically about 3 hours. During the defrost cycle, the refrigerant from the discharge side of the compressor flows directly to the evaporator and then back through the auxiliary heat exchanger to the suction side of the compressor. However, at the start of a defrost cycle, it is necessary to have a high compressor head pressure in order to rapidly force the warm refrigerant through the evaporator coil. Accordingly, to insure that a high head pressure exists at the start of defrost, the receiver is connected through the auxiliary heat exchanger directly to the suction side of the compressor for a period of time, typically about two minutes. At the termination of this pre-defrost cycle, and after a build-up of compressor head pressure is assured, the receiver is disconnected from the auxiliary heat exchanger and, instead, the refrigerant flowing directly from the evaporator then passes through the auxiliary heat exchanger back to the suction side of the compressor.

In both the refrigeration and defrost cycles, therefore, the refrigerant passes through the auxiliary heat exchanger which, during refrigeration, subcools the refrigerant prior to its passage to the expansion device and the evaporator and which, during defrost, serves to add heat to the vaporized refrigerant entering the suction intake of the compressor.

The above and other objects and features of the invention will become apparent from the following detailed description taken in connection with the accompanying drawings which form a part of this specification, and in which.

Figure 1:
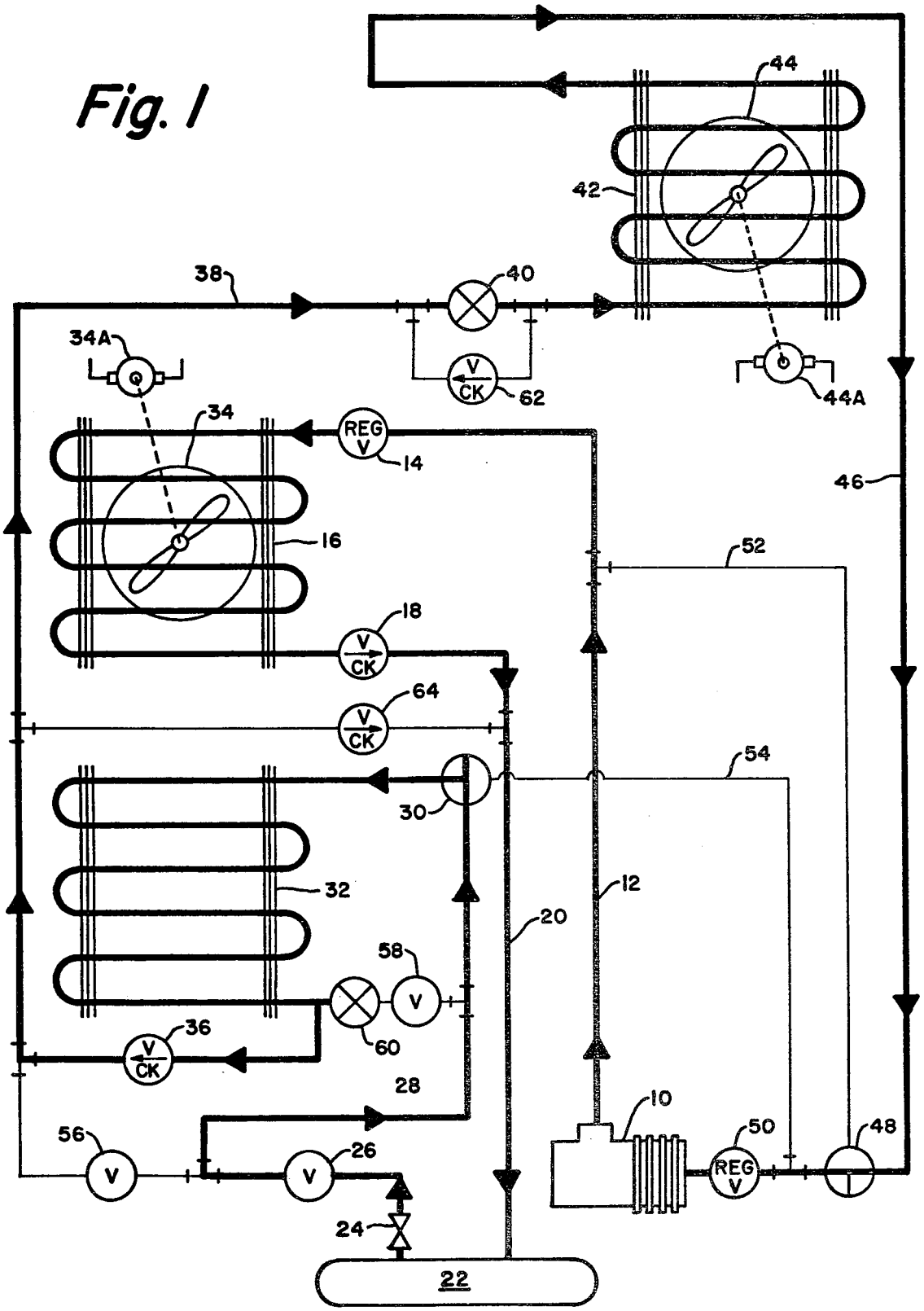
FIG. 1 is a schematic diagram of the refrigeration system of the invention showing its operation during a normal refrigeration cycle.

With reference now to the drawings, and particularly to FIG. 1, the refrigeration system shown includes a conventional compressor 10 which, during a normal refrigeration cycle, pumps hot, compressed refrigerant through a conduit 12 and a discharge pressure regulator valve 14 to a conventional condenser heat exchanger 16. From the heat exchanger 16, the condensed refrigerant flows through a check valve 18 and conduit 20 to a receiver 22 where it is collected. Liquid refrigerant from the receiver then flows through a hand valve 24, a liquid solenoid valve 26, conduit 28 and a three-way solenoid valve 30 to an auxiliary heat exchanger 32 which subcools the liquid refrigerant. In the usual case, the two heat exchangers 16 and 32 will be in tandem or in the same fin bundle such that cooler air forced through the combined heat exchangers by a condenser fan 34 will serve not only to condense the refrigerant from the compressor 10, but also to subcool the liquid refrigerant in heat exchanger 32.

From the auxiliary heat exchanger 32, the subcooled liquid refrigerant flows through a check valve 36 and conduit 38 to an expansion valve 40 at the input to a conventional evaporator heat exchanger 42. In the evaporation process, heat is transferred from warmer air forced through the fins of the heat exchanger 42 by means of an evaporator fan 44, as is conventional.

From the evaporator 42, the evaporated, gaseous refrigerant then passes through conduit 46, a three-way solenoid valve 48 and suction pressure regulator valve 50 back to the suction intake of the compressor 10. During the refrigeration cycle just described, the conduits shown in light lines are not used and no refrigerant flows therethrough.

As was explained above, in a defrost cycle, hot refrigerant from the discharge side of the compressor 10 is caused to flow in a reverse direction through conduit 46 and back through the evaporator heat exchanger 42. However, in order to ensure that the hot gas will be forced into the evaporator in the initial stages of defrost, it is necessary to produce a relatively high head pressure at the output of the compressor. This may not always occur where, for example, the defrost cycle is initiated just after the compressor has started in response to a rise in temperature in the space being heated. Accordingly, there is provided a pre-defrost phase which is shown schematically in FIG. 2 where elements corresponding to those of FIG. 1 are identified by like reference numerals. At this time, three-way solenoid-operated valves 30 and 48 are actuated such that conduit 46 is now connected to conduit 12 through conduit 52; and the suction inlet of compressor 10 is connected through conduit 54 and the three-way valve 30 to the auxiliary heat exchanger 32. At the same time, solenoid valve 56 remains closed such that liquid refrigerant from the receiver 22 now flows through solenoid valve 26 (which is now open), solenoid valve 58 (which opens at this time), and an expansion valve 60 into the auxiliary heat exchanger 32. Additionally, fan 44 is not operating. In passing through the expansion valve 60, the refrigerant is vaporized and absorbs heat from warmer air moved by fan 34 in passing through the heat exchanger 32. Thereafter, it passes through conduit 54 to the suction inlet of the compressor 10. From the compressor 10, the compressed refrigerant will now pass through conduits 12 and 52, since it is blocked by the closed pressure regulating valve 14, and through conduit 46 to the evaporator heat exchanger 42. In passing through the heat exchanger 42, the heat of condensation of the compressed refrigerant acts to defrost the coil surface. From the evaporator 42, the refrigerant then passes through check valve 62, which bypasses expansion valve 40, thence through conduit 38 and check valve 64 back to the receiver 22. The valve 56 is closed at this time; while check valve 36 blocks the flow of refrigerant in conduit 38 from entering the auxiliary heat exchanger 32.

Figure 2:
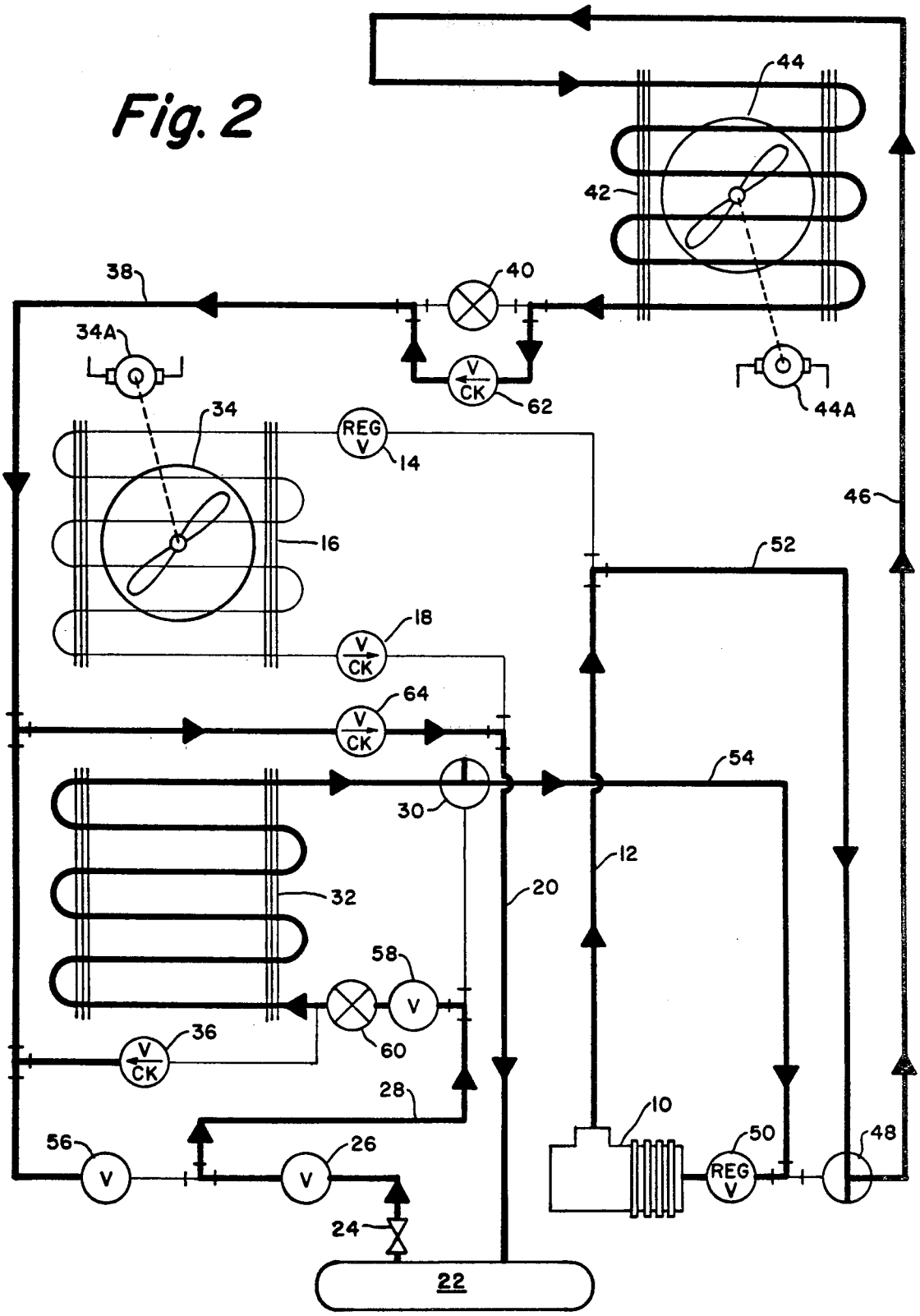
FIG. 2 is a schematic diagram similar to FIG. 1 but showing the path of the refrigerant in bold lines during the pre-defrost phase of operation.
Figure 3:
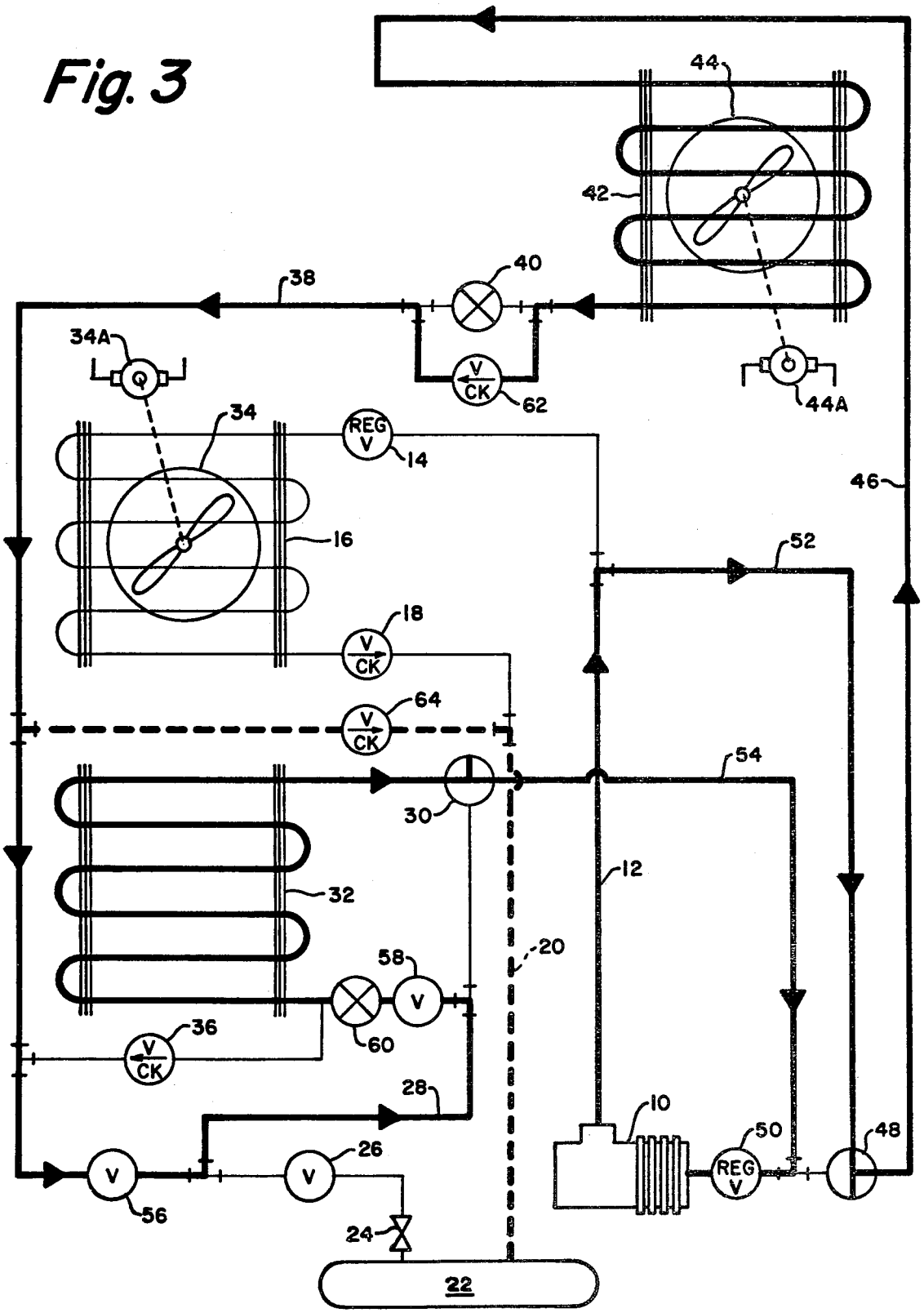
FIG. 3 is a schematic diagram similar to that of FIG. 1 but showing the flow of the refrigerant in bold lines during a defrost cycle.

The mode of operation illustrated in FIG. 2 normally persists for about two minutes, whereupon valve 26 closes and valve 56 opens. Under these circumstances, and as shown in FIG. 3, the refrigerant in conduit 38 now flows through valve 56 and open valve 58 to expansion valve 60 and the auxiliary heat exchanger 32. Any excess refrigerant in conduit 38 flows through the check valve 64, which is spring-biased to permit passage of refrigerant only when its pressure rises above a predetermined level. This excess refrigerant then flows back to the receiver 22 via conduit 20.

During pre-defrost and the defrost cycle, the evaporator fan 44 is inoperative as was explained above. The auxiliary heat exchanger 32, during this period, transfers heat from the ambient atmosphere to the evaporating refrigerant to assist in maintaining the pressure of the refrigerant at a sufficiently high level and to provide heat which is subsequently transferred to the defrosting evaporator coil 42. If desired, an auxiliary source of heat may be utilized to add heat to the heat exchanger 32 during the defrost cycle. This auxiliary heat source may, for example, be obtained through the utilization of waste heat such as that discharged from the condenser of another refrigeration unit in its refrigeration cycle to provide the ambient heating air for the defrost cycle of a second such system. In this respect, all of the various systems in a multiple compressor plant may be interrelated so that the defrosting cycles of each system utilize the heat discharged from one or the other systems.

Figure 4:
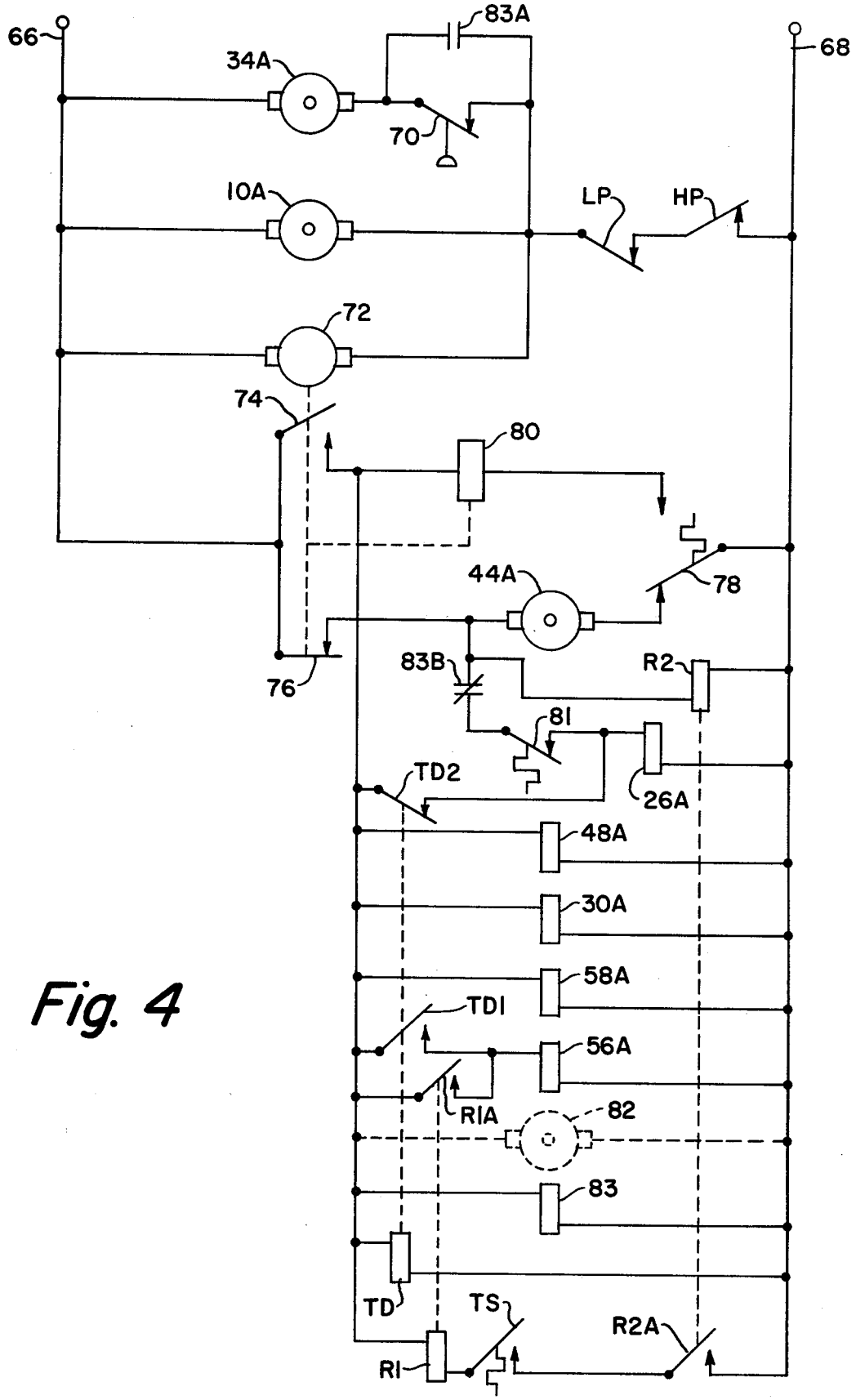
FIG. 4 is a schematic circuit diagram showing the electrical controls for the refrigeration system of the invention.

The electrical control system for the refrigeration system of the invention is illustrated in FIG. 4. It includes a pair of terminals 66 and 68 adapted for connection to a source of potential, not shown. Connected between the terminals 66 and 68 is the motor 10A for compressor 10 in series with a low pressure switch LP and a high pressure switch HP, respectively. In shunt with the motor 10A is the motor 34A for the condenser fan 34 connected in series with a high pressure cut-in switch 70. Switch 70 will close to start the fan 19 only when the pressure at the input to the condenser exceeds a predetermined value. During the defrost cycle, the pressure at the input to the condenser may be insufficient to maintain the switch 70 closed. Hence, an auxiliary contact 70A is provided to maintain motor 34A in operation.

The low pressure switch LP is responsive to pressure in the suction line 46 and will open when the pressure in the suction line drops to the point where the compressor is pumping out the evaporator. This is an operating control and may trip, for example, when the liquid line solenoid valve 26 is deenergized and closes, when thermostat 81 breaks contact. Similarly, the high pressure safety switch HP is connected to the discharge side of the compressor 10 and will trip when the discharge pressure exceeds a predetermined value.

Also in shunt with the compressor motor 10A is a timer motor 72 which will run during the same time periods that the compressor motor 10A is operative. The timer motor 72 operates two contacts 74 and 76. During normal refrigeration, contact 76 will be closed as shown in FIG. 4 while contact 74 will be open. The period of the timer motor 72 is typically about three hours, meaning that the refrigeration cycle will continue for three hours of compressor operation before a defrost cycle is initiated. During a refrigeration cycle, with contact 76 closed, the motor 44A for the evaporator fan 44 shown in FIGS. 1-3 will be energized through a defrost terminating thermost 78 which is normally in the cold position shown so as to connect one terminal of motor 44A to terminal 68. The thermostat 78 has its temperature sensing bulb attached to the coldest point of the evaporator heat exchanger 42. As the defrost cycle proceeds, a point will be reached where the evaporator will heat up to the point where the position of the contacts of thermost 78 are reversed, thereby energizing a timer release solenoid 80 through contacts 74 (which are closed during the defrost cycle) to terminate the defrost cycle.

During the refrigeration cycle, with contacts 76 closed, a solenoid 26A for valve 26 shown in FIGS. 1-3 will be energized to open the valve. The solenoid 26A is connected in series with a thermostat switch 81. The thermostat 81 is in the enclosure which is being refrigerated and will open or close depending upon the temperature therein. When the enclosure temperature is lowered to a predetermined value, thermostat switch 81 opens, whereupon solenoid 26A is deenergized and valve 26 closes. When this occurs, the pressure in conduit 46 is reduced, and the low pressure switch LP opens to stop the compressor 10. When the temperature again rises within the space being cooled and switch 81 closes, valve 26 again opens, the pressure within the receiver 22 causes the low pressure switch LP to close, and the compressor 10 and condenser fan 34 are again started.

Assuming that the period of timer 72 has expired and that defrost is to begin, contacts 74 close while contacts 76 open to deenergize the evaporator fan motor 44 as explained above. When contacts 74 close, a time delay relay TD is energized. The time delay relay TD has normally-open contacts TD1 and normally-closed contacts TD2. The period of the time delay relay is approximately two minutes. Consequently, contacts TD2 will remain closed to maintain solenoid 26A energized and valve 26 open as shown in FIG. 2. At the same time, solenoid 58A for valve 58 shown in FIGS. 1-3 is energized to open the valve 58; while solenoid 30A is energized to place the three-way valve 30 in the position shown in FIG. 2. If an auxiliary fan, not shown in FIGS. 1-3, is utilized to force heated air through the auxiliary heat exchanger 32, the heat source fan motor 82 is energized. If the condenser fan is used to move air through the heat source, relay 83 closes contacts 83A for the duration of the defrost cycle. Relay 83 also serves to break contact 83B during defrost to prevent fan 44A from running when TD2 is closed. Finally, the solenoid 48A for the three-way valve 48 is energized such that the valve 48 assumes the position shown in FIGS. 2 and 3.

At the termination of the two-minute period of time delay relay TD, the pre-defrost phase shown in FIG. 2 terminates and the defrost cycle of FIG. 3 is initiated. This is accomplished by virtue of the fact that contacts TD2 now open, thereby closing valve 26. At the same time, contacts TD1 close to energize the solenoid 56A for valve 56, thereby opening the valve to permit the flow of refrigerant shown in FIG. 3. The defrost cycle continues until the thermostatic switch 78 energizes the timer release solenoid 80 through contacts 74. This causes the timer to open contacts 74 and close contacts 76; whereupon a refrigeration cycle is again initiated and the timer motor 72 again starts its period.

It will be understood, of course, that the use of the auxiliary heat exchanger 32 during the normal refrigeration cycle (FIG. 1) will lengthen the path of flow for the refrigerant and the pump-down operation. When the ambient temperature around the heat exchangers 16 and 32 is approximately 70° F. or lower, sufficient subcooling is produced in the condenser 16 so that the auxiliary heat exchanger 32 may not be required. The heat exchanger 32, under these conditions, may be bypassed by simply opening the valve 56 when the temperature falls below about 70° F. Under these conditions, no flow-through to auxiliary exchanger 32 will take place for the reason that the slightly higher pressure in conduit 38 will close the check valve 36 and block flow through conduit 28 and heat exchanger 32. Valve 56, of course, must permit the flow in both directions.

With reference again to FIG. 4, the valve 56 is opened when the temperature around the coils 16 and 32 drops below about 70° F. by means of a thermostatic switch TS which closes when the temperature drops below about 70° F. When switch TS closes, relay R1 is energized to close contacts R1A in shunt with contacts TD1 of relay TD. Consequently, when the temperature drops below about 70° F., solenoid 56A will be energized to open valve 56. Note, however, that relay R1 cannot be energized unless relay R2 is energized to close contacts R2A. Relay R2, in turn, is energized only when solenoid 26A is energized during the refrigeration cycle as contrasted with a defrost cycle.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a reversible refrigeration system of the type including a compressor having discharge and suction sides, a condenser, a liquid refrigerant receiver, an auxiliary heat exchanger, an expansion device and an evaporator interconnected in a closed circuit to provide a normal refrigeration cycle wherein refrigerant flows from the discharge side of said compressor, through the condenser to the receiver, then through the auxiliary heat exchanger and through the expansion device to the evaporator and back to the suction side of the compressor, and wherein flow of refrigerant through the auxiliary heat exchanger is optional during the normal refrigeration cycle; the improvement of apparatus including valve means operative at the termination of a refrigeration cycle and prior to initiation of a defrost cycle for connecting said receiver through said auxiliary heat exchanger to the suction side of said compressor while connecting the discharge side of the compressor to said evaporator with the flow of refrigerant from the evaporator flowing back to the receiver, and apparatus including valve means operative during a defrost cycle for connecting the discharge side of the compressor to one side of said evaporator while connecting the other side of the evaporator through said auxiliary heat exchanger to the suction side of said compressor with the flow of refrigerant from the receiver into the refrigeration system being blocked.

2. The improvement of claim 1 wherein refrigerant flows from the evaporator to the compressor during a refrigeration cycle through the same conduit through which refrigerant flows from the compressor to the evaporator during a defrost cycle.

3. The improvement of claim 1 wherein the condenser and auxiliary heat exchanger are connected in tandem such that a single condenser fan can force cooling air through the condenser and auxiliary heat exchanger during a refrigeration cycle.

4. the improvement of claim 1 including means for forcing heated air through said auxiliary heat exchanger during a defrost cycle.

5. The improvement of claim 1 wherein said receiver is connected to said auxiliary heat exchanger through a second expansion device at the termination of a refrigeration cycle and prior to defrost.

6. The improvement of claim 5 including valve means for disconnnecting said receiver from the second expansion device and for connecting said evaporator to the second expansion device when said defrost cycle is initiated.

7. The improvement of claim 1 including a check valve connected in shunt with said expansion device to permit refrigerant to flow from said evaporator to said auxiliary heat exchanger during a defrost cycle.

8. The improvement of claim 1 including means operable when the ambient temperature about said auxiliary heat exchanger drops below a predetermined level for causing refrigerant to bypass the auxiliary heat exchanger and flow from the receiver to the expansion device during a normal refrigeration cycle.

9. The improvement of claim 8 wherein the means for causing the refrigerant to bypass the auxiliary heat exchanger includes a conduit bypassing said heat exchanger, a normally-closed valve in said conduit, thermostat means for sensing the temperature around said auxiliary heat exchanger, and means for opening said normally-closed valve when the temperature sensed by said thermostat means drops below said predetermined level.

10. The improvement of claim 9 including a check valve connecting the exit end of said auxiliary heat exchanger to said bypass conduit.

* * * * *